US006976586B2

(12) United States Patent
Halpin

(10) Patent No.: US 6,976,586 B2
(45) Date of Patent: Dec. 20, 2005

(54) DELICATE PRODUCT PACKAGING SYSTEM

(75) Inventor: Michael W. Halpin, Scottsdale, AZ (US)

(73) Assignee: ASM America, Inc., Phoenix, AZ (US)

( * ) Notice: Subject to any disclaimer, the term of this patent is extended or adjusted under 35 U.S.C. 154(b) by 33 days.

(21) Appl. No.: 10/144,158

(22) Filed: May 10, 2002

(65) Prior Publication Data

US 2003/0209463 A1 Nov. 13, 2003

(51) Int. Cl.[7] ..... B65D 81/02
(52) U.S. Cl. ..... 206/583; 206/454
(58) Field of Search ..... 206/583, 591–594, 206/454, 441, 455; 190/13 C, 28, 36; 220/57 S, 220/629, 631, 632, 4.24; 312/327, 328; 446/124, 446/125, 73, 75, 76; 24/457, 459, 703.1

(56) References Cited

U.S. PATENT DOCUMENTS

| | | | | | |
|---|---|---|---|---|---|
| 1,813,256 | A | | 7/1931 | Radkus | |
| 1,986,344 | A | * | 1/1935 | Kippelman | 206/591 |
| 2,050,909 | A | | 8/1936 | Woodall | |
| 2,330,346 | A | * | 9/1943 | Elliott | 206/583 |
| 2,626,705 | A | | 1/1953 | Ash | |
| 2,943,731 | A | | 7/1960 | Brown | |
| 3,059,830 | A | | 10/1962 | Kramer | |
| 3,185,198 | A | * | 5/1965 | Bryan | 206/591 |
| 4,087,003 | A | * | 5/1978 | Adamek | 206/583 |
| 4,395,451 | A | | 7/1983 | Althouse | |
| 4,491,225 | A | | 1/1985 | Baillod | |
| 4,667,944 | A | | 5/1987 | Althouse | |
| 4,711,014 | A | | 12/1987 | Althouse | |
| 4,718,549 | A | * | 1/1988 | Rissotti et al. | 206/710 |
| 4,778,326 | A | | 10/1988 | Althouse et al. | |
| 5,064,063 | A | | 11/1991 | Manca et al. | |
| 5,273,159 | A | * | 12/1993 | Gregerson | 206/710 |
| 5,287,968 | A | * | 2/1994 | Ridgeway | 206/583 |
| 5,452,795 | A | * | 9/1995 | Gallagher et al. | 206/711 |
| 5,641,068 | A | * | 6/1997 | Warner | 206/523 |
| 5,682,731 | A | | 11/1997 | Althouse | |
| 5,738,216 | A | * | 4/1998 | Warner | 206/523 |
| 5,769,235 | A | * | 6/1998 | Keach | 206/583 |
| 5,769,237 | A | | 6/1998 | Althouse et al. | |
| 5,908,114 | A | | 6/1999 | Althouse et al. | |
| 5,988,387 | A | * | 11/1999 | Staal et al. | 206/583 |
| 6,105,781 | A | * | 8/2000 | Kjima et al. | 206/710 |
| 6,547,200 | B2 | * | 4/2003 | Dilworth | 248/316.5 |
| 6,591,987 | B2 | * | 7/2003 | Wu et al. | 206/454 |
| 6,629,616 | B1 | * | 10/2003 | Heinzle | 211/85.7 |

* cited by examiner

*Primary Examiner*—Shian T. Luong
(74) *Attorney, Agent, or Firm*—Knobbe Martens Olson & Bear LLP

(57) ABSTRACT

The packaging system comprises a first plurality of interlaced fingers disposed in the upper portion of a box, and a second plurality of interlaced fingers disposed in a lower portion. The fingers provide provide a soft support for a product placed between the fingers.

6 Claims, 5 Drawing Sheets

DELICATE PRODUCT PACKAGING SYSTEM

BACKGROUND OF THE INVENTION

1. Field of the Invention

The invention relates in general to the field of packaging, and more specifically to a method and apparatus for packaging delicate products, the method and apparatus being compatible with clean room standards.

2. Description of the Related Art

Many manufacturing industries require delicate parts to be packaged and then shipped to a customer. Delicate instruments such as thermocouples, and various quartz components are typically double bagged, and placed in a cardboard box lined with soft foam. This system is very successful in protecting the delicate components from being damaged during shipping. Unfortunately however, the cardboard and foam used for this type of packaging are not cleanroom compatible due to the significant quantity of particulate released into the air by these materials. Thus, products must be removed from the protective packaging and cleaned of any loose particles before the part can be taken into the clean room.

For many cleanroom applications, having a non-cleanroom compatible packaging system is undesirable for a number of reasons. First, the additional unprotected transportation of the products can lead to damage or breakage before the product is installed or otherwise used. The non-cleanroom compatible packaging system is also undesirable due to the significant quantity of material which must be discarded once the product has been shipped. The cardboard and foam packaging is also not particularly reusable due to the difficulty in cleaning them.

It is therefore desirable to have a packaging system which protects delicate products from damage during shipping, which can be taken into a cleanroom, and which is substantially reusable.

SUMMARY OF THE INVENTION

In one aspect of the system described herein, a box is provided having a plurality of fingers adapted to support a product placed between the fingers. In one embodiment, a first plurality of interlaced fingers may be mounted to a top of the box, and a second plurality of interlaced fingers may be mounted to a bottom of the box, such that a product may be sandwiched therebetween.

In another embodiment, a method of packaging a delicate product is provided. The method of this embodiment generally comprises providing a box having a top portion and a bottom portion, providing a first plurality of flexible fingers on the top portion, and a second plurality of flexible fingers on the bottom. A product is then placed on the second plurality of fingers, such that upon closing the box, the product is sandwiched between the first plurality of fingers and the second plurality of fingers.

Another embodiment describes a packaging apparatus comprising a top portion having a top wall, a front wall a rear wall, and a plurality of sides; and a bottom portion having a bottom wall, a front wall, a rear wall, and a plurality of sides. According to this embodiment, a first sheet of flexible fingers is mounted to the front wall of the top portion, a second sheet of flexible fingers mounted to the rear wall of the top portion, a third sheet of flexible fingers mounted to the front wall of the bottom portion, and a fourth sheet of flexible fingers mounted to the rear wall of the bottom portion. Additionally, the fingers of the first sheet interlace the fingers of the second sheet; and the fingers of the third sheet interlace the fingers of the fourth sheet.

In yet another embodiment a packaging system for use in a cleanroom is described as having a single-piece box having first and second pluralities of interlaced fingers mounted in the box such that a product may be sandwiched between the first and second pluralities of interlaced fingers, thereby protectively supporting the product.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the present invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the packaging system and methods, certain preferred embodiments and modifications thereof will become apparent to those skilled in the art from the detailed description herein having reference to the figures that follow, of which.

DETAILED DESCRIPTION OF THE PREFERRED EMBODIMENT

Embodiments of a container will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes, nor is any single element necessarily essential to practicing the invention herein described.

Figure 1:
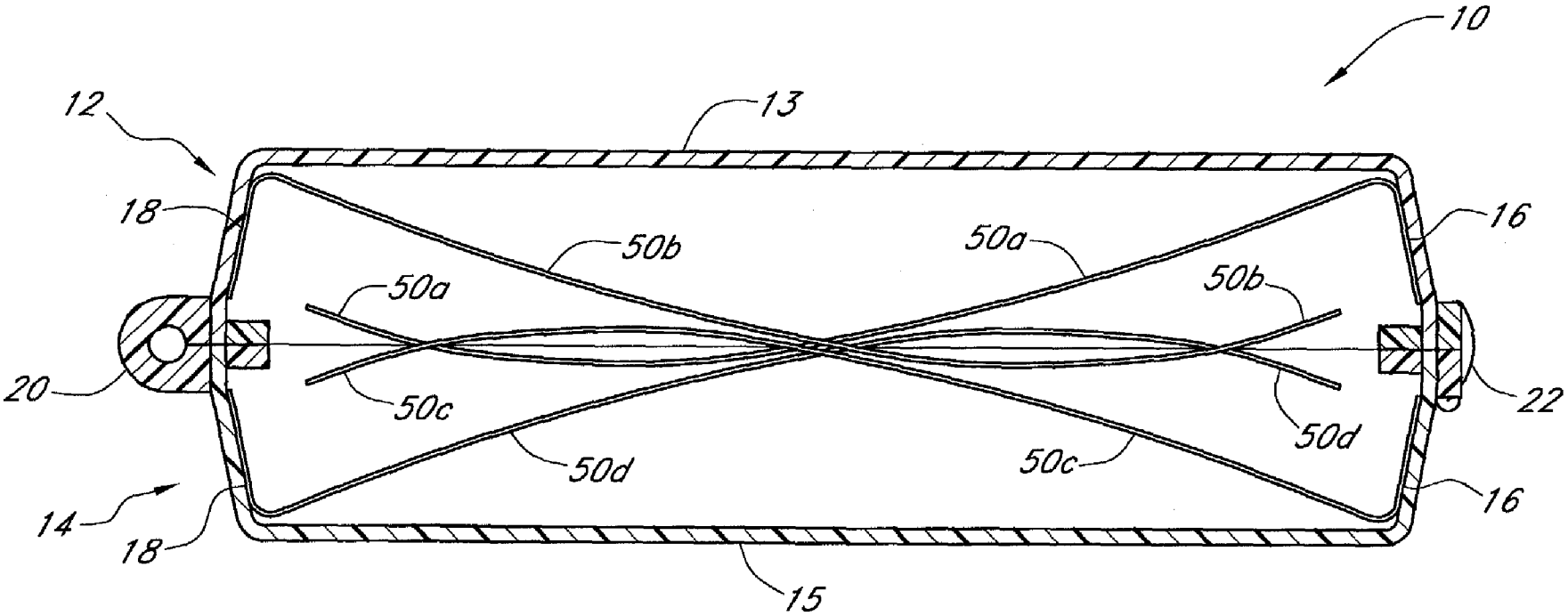
FIG. 1 is a side cross section of a container with a side elevational view of fingers within the container.
Figure 2:
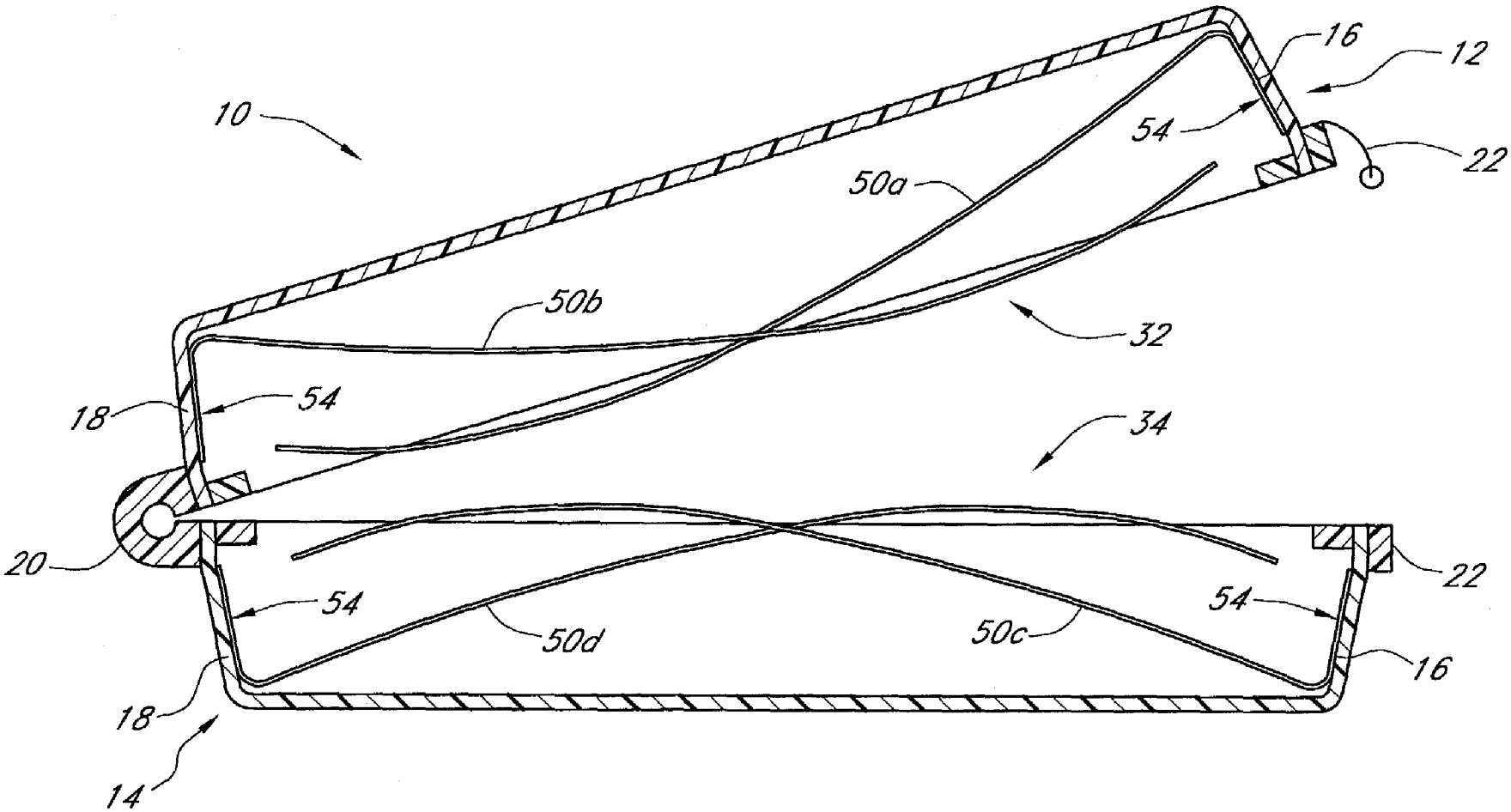
FIG. 2 is a view of the container of FIG. 1 shown in an open position.

FIGS. 1 and 2 illustrate a box or container 10 having a top 12, a bottom 14, and a suspension system. The box 10 may be made from any appropriate material, and using any appropriate method known to those skilled in the art. For example, in one embodiment, the box may be made from a suitable polymer such as polyethylene, polypropylene, etc by blow molding, vacuum molding, injection molding, etc. Other materials and methods may be used depending on the product to be packaged.

The illustrated top 12 comprises a top wall 13, a front wall 16, a rear wall 18, and a plurality of side walls. Similarly, the bottom comprises a bottom wall 15, a front wall 16, a rear wall 18, and a plurality of side walls. In the embodiment shown in FIG. 2, the top and bottom are substantially symmetrical across a horizontal line drawn through the center of the box. In alternative embodiments, however, the top and bottom may comprise shapes different from one another provided that they perform as described herein.

According to the embodiment shown, the top 12 and bottom 14 may be attached to one another at their respective rear walls by a hinge 20. The hinge 20 may be made from a variety of materials in a variety of shapes such that the top 12 may pivot relative to the bottom 14 about a hinge axis. The container 10 may include a plurality of hinges disposed along the length of an edge of the box 10 such that the top and bottom are pivotable relative to one another.

The container 10 may also include one or more latches 22 located at any appropriate position on the box 10. In the illustrated embodiment, the latch 22 is shown at the front walls of the box, opposite the hinge. The latch 22 may be designed to include any number of specific shapes and mechanisms which facilitate secure closure of the box 10.

The box 10 may have a variety of shapes as viewed from above. For example, the box may be substantially square, rectangular, circular, elliptical or otherwise shaped depending on the shape of the particular product to be contained therein and other factors. Additionally, if desired, the box may be color coded to correspond to the particular product contained therein, such as by molding a portion of the box from a suitably colored plastic. Alternatively, color coding may be applied in any other manner known to those skilled in the art. The particular color-coded classification system will of course vary according to the user's needs.

Figure 4:
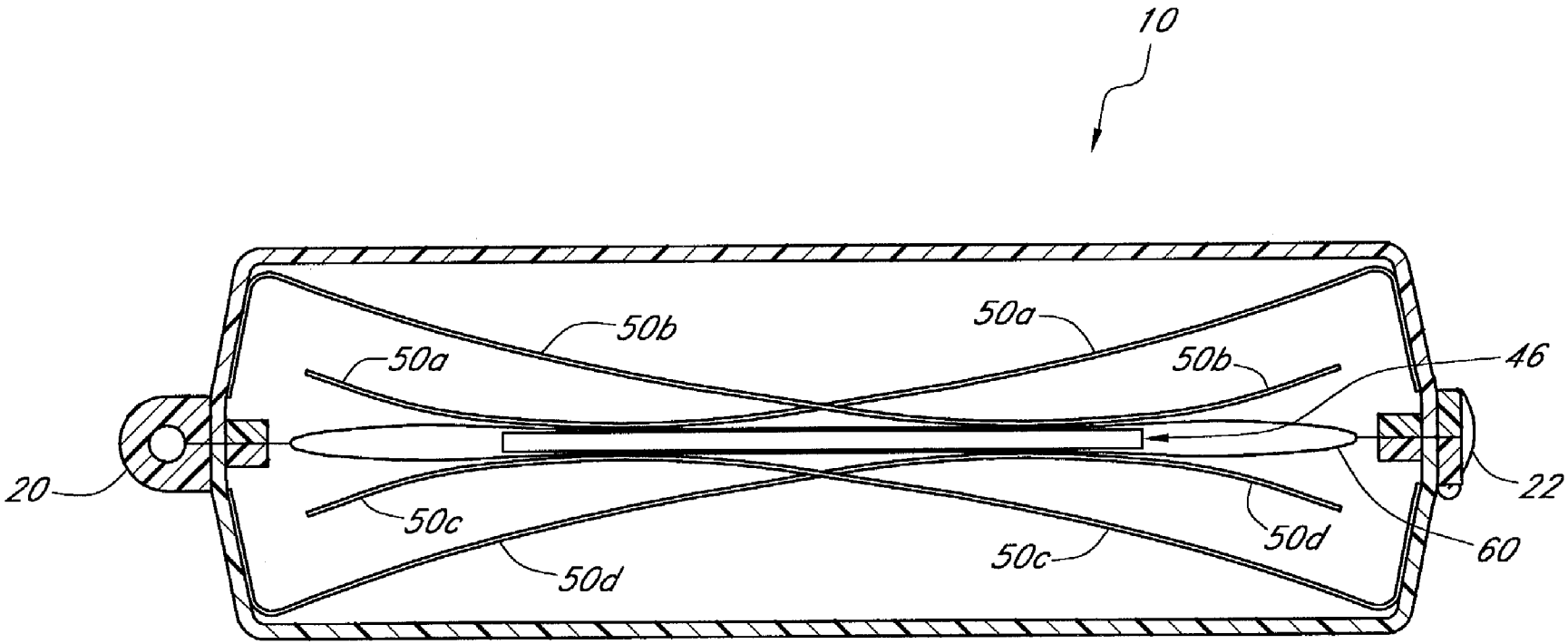
FIG. 4 is a view of the container of FIG. 1 having a product held therein.

With specific reference to FIG. 4, the container also preferably includes a suspension system generally including a first plurality of fingers 32 attached to the top portion 12 of the box 10, and a second plurality of fingers 34 attached to the bottom portion 14 of the box 10. A product may then be placed between the first and second plurality of fingers such that it is supported therebetween. The flexible fingers preferably allow an irregularly shaped product to be softly supported substantially in the center of the box.

Figure 3B:
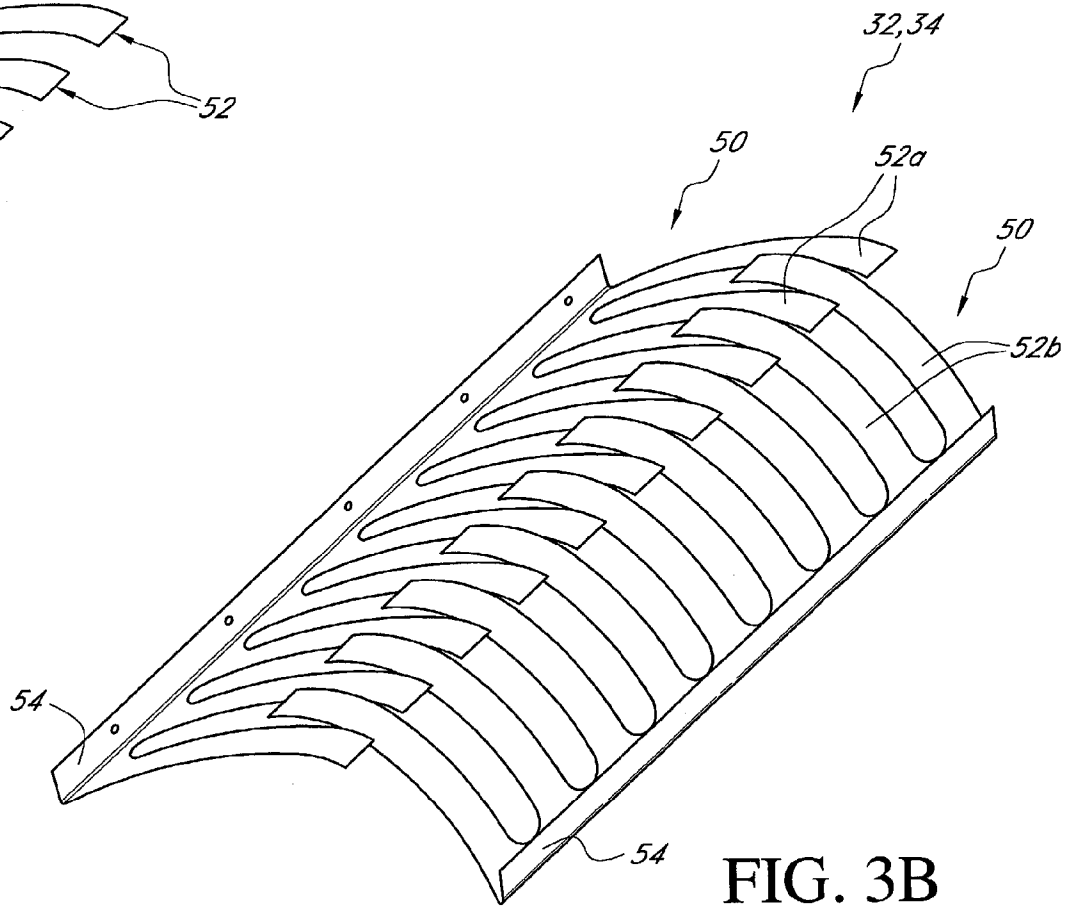
FIG. 3B is a perspective view of a pair of sheets of the fingers of FIG. 3A with the fingers interlaced.
Figure 3A:
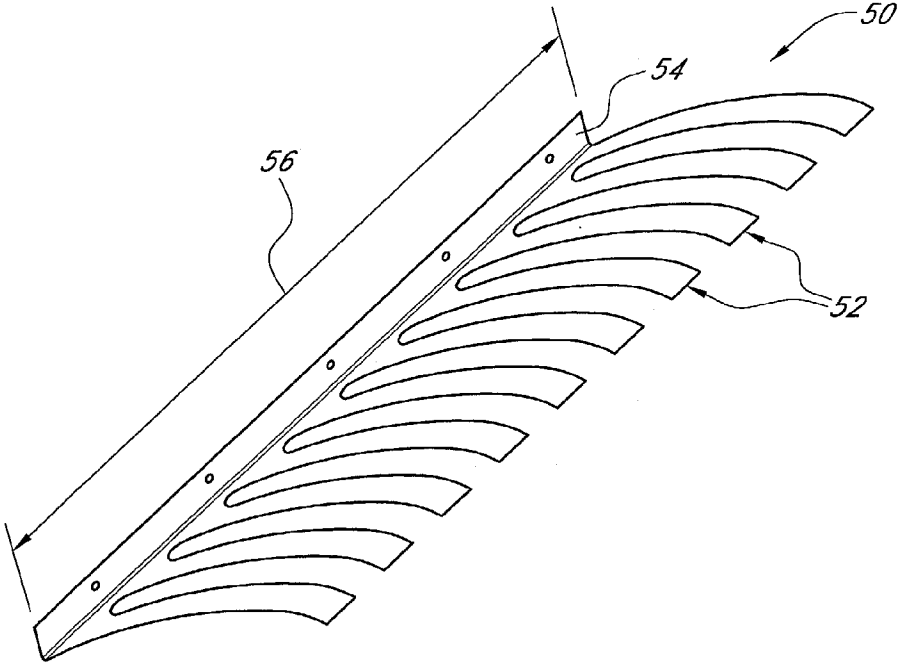
FIG. 3A is a perspective view of a sheet of fingers that may be used in the container of FIG. 1.

FIG. 3A illustrates one embodiment of a sheet of fingers for use in a packaging suspension system as described herein. A sheet 50 of flexible fingers 52 generally comprises a longitudinal mounting strip 54, and a plurality of flexible fingers 52 extending in a cantilevered manner therefrom. The mounting strips 54 are generally the same thickness as the material of the fingers 52, however a mounting strip may be provided with a greater thickness for added rigidity, or a smaller thickness for increased flexibility. If desired, a sheet of fingers may be provided with mounting strips 54 on both ends of the fingers 52 (see FIG. 5), thus providing the possibility of supporting the fingers in a non-cantilevered manner. The mounting strip 54 is preferably of such a length 56 that the sheet 50 extends substantially the entire length of the box interior. The fingers 52 are shown in FIGS. 1–4 as being supported in a cantilevered manner by the mounting strip 54 as will be recognized by those skilled in the art. The sheets of fingers 50 are preferably cut from thin plastic sheets, but may be made from any appropriate material or method known to those skilled in the art. The fingers are preferably sufficiently resilient to provide a substantially soft support to a product placed thereon as described elsewhere herein.

The fingers 52 may have a number of cross-sectional shapes. For example, the fingers 52 may comprise a substantially flat rectangular cross section, a circular wire-like cross-section, an elliptical cross-section, or any other desirable cross sectional shape. The flexibility, and thus the "softness" of support, may be varied by changing the shape, size and/or material of the fingers.

The fingers 52 mounted to the top 12 and bottom 14 are preferably curved as shown such that they are concave relative to the top 12 and bottom 14 respectively. Alternatively stated, the fingers 52 may be formed or installed such that they are convex relative to the product 46 placed between the fingers 52. The radius of curvature of the fingers may be varied to provide firmer or softer support to a product in a package as described herein. For example, in packaging products typically used in the semiconductor manufacturing industry, a radius of curvature of the fingers of between about 4" and about 6" has been found to be suitable. Of course radii outside of this range may be desirable depending on the particular products to be shipped. Also, curvature other than circular may be employed. The fingers 52 are preferably of sufficient length that they extend substantially the entire width (front-to-rear) of the interior of the box when the box is assembled. This insures that a product placed between the top and bottom pluralities of fingers will remain supported therebetween.

Figure 5:
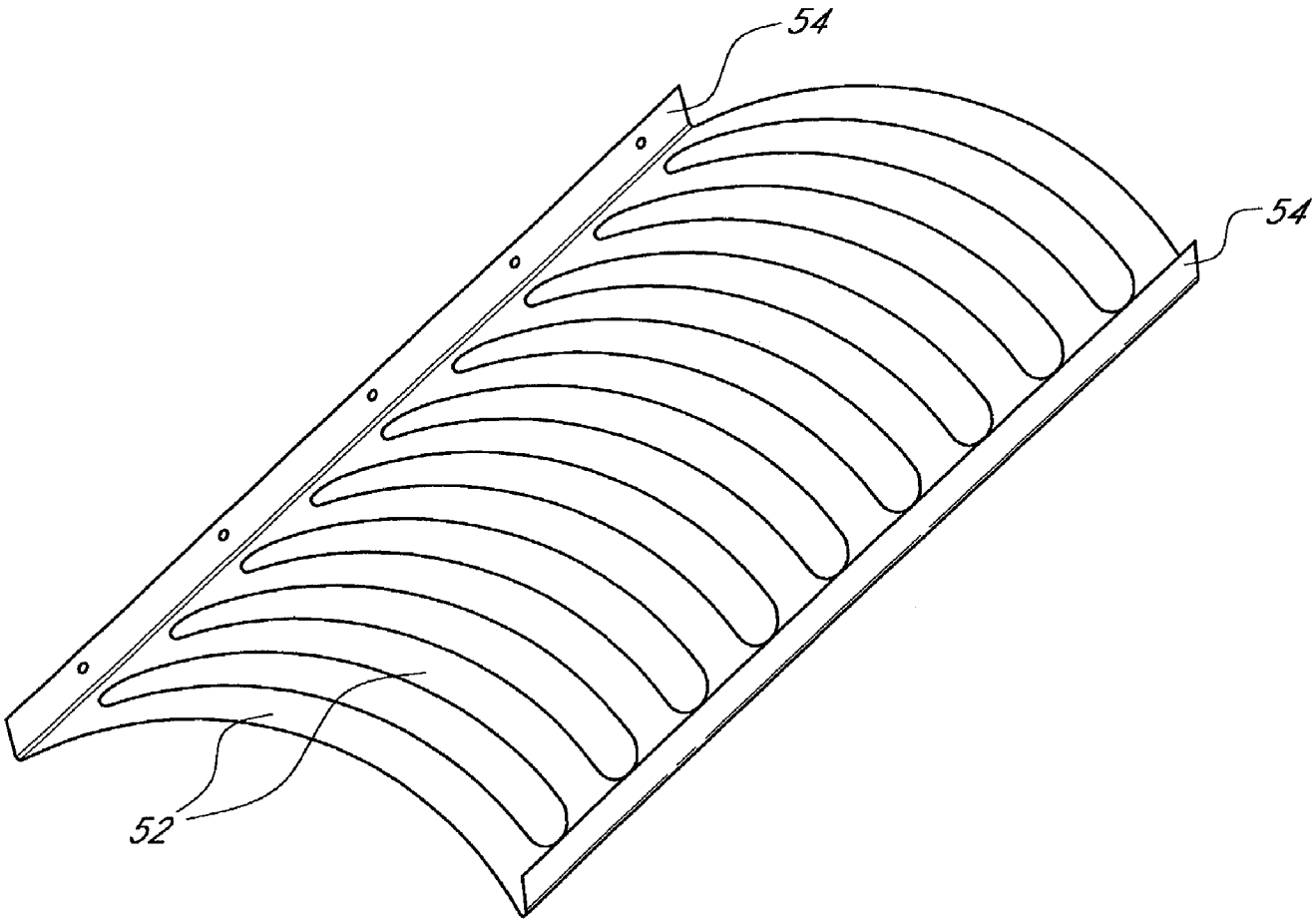
FIG. 5 is a perspective view of an alternative embodiment of a sheet of fingers.

A suspension system may be provided wherein the first plurality and/or the second plurality of fingers comprises a single sheet of flexible fingers 52 adapted to support a product. The single sheet 50 of fingers may be mounted to a front, rear, or side wall of the box in a cantilevered manner, or the sheet of fingers may be adapted to be attached to the box such that the fingers are supported at both ends, as shown in FIG. 5. The fingers preferably have sufficient resilience that the product is provided with a substantially soft support. The fingers 52 will be said to provide a sufficiently "soft" support if a delicate product sandwiched between the first and second pluralities of fingers is protected from damage during impact forces typically encountered during shipping. The spacing between the fingers 52 may be varied as desired, provided that the product is sufficiently supported thereon.

With particular reference now to FIGS. 2 and 3B, the pluralities of fingers 32, 34 may comprise a pair of sheets 50 of fingers 52 mounted in the box such that the fingers 52*a* of one sheet interlace the fingers 52*b* of another. In order to interlace the spaces between the fingers must of course be greater than the width of the fingers. The first plurality 32 of fingers may comprise first 50*a* and second 50*b* sheets of flexible fingers mounted to the front 16 and rear 18 walls of the top 12 respectively as shown, and the second plurality 34 of fingers may comprise third 50*c* and fourth 50*d* sheets of flexible fingers mounted to the front 16 and rear 18 of the bottom 14 respectively as shown. The fingers of the first plurality 32 are thus interlaced with one another, and the fingers of the second plurality 34 are interlaced with one another as well. Additionally, if desired, the first and second pluralities of fingers 32, 34 may be mounted in the box 10 such that the sheets of fingers 50 mounted to the top portion 12 will interlace the sheets of fingers 46, 48 of the bottom portion 14.

In FIGS. 1, 2, and 4 the sheets of fingers 50 are shown mounted to the front 16 and rear walls 18. Alternatively, the sheets of fingers 50 may be mounted to the top, bottom, sides, or any other interior surface as desired. The mounting strips 54 may be attached to the box 10 by any appropriate method, such as welds, adhesives, or various mechanical fasteners. As mentioned above, the fingers may be cantilevered as shown, or the fingers may be supported at both ends.

Products are typically placed in a bag, which will then be placed between the flexible fingers 52 of the container 10. The particular material and shape of the bag may vary according to the product to be shipped, or the materials from which the sheets of fingers are made, or any of a number of other factors. The friction between the fingers and the bag, is preferably sufficiently large that the bag does not slide significantly between the fingers. In one embodiment, the bag is sized such that the edges of the bag nearly contact the front, rear, and/or sides of the box, thereby preventing the bag, and the product therein, from sliding significantly relative to the box.

With reference now to FIG. 4, the fingers 52 are preferably sufficiently resilient that they may support a delicate product 46 placed directly thereon, but sufficiently pliant to substantially eliminate the transfer of shock forces from the outside of the box to the product contained therein. This resilience may be quantified in terms of a spring constant. Those skilled in the art will recognize that the spring constant is related to force and displacement according to the following equation:

$$F=Kd$$

Where

F=the force or shock load;

K=spring constant; and d=displacement.

Thus fingers having a larger spring constant will allow a product placed on the fingers to be more immobilized relative to the walls of the box. A smaller spring constant will allow the product to bend the fingers more and to move within the box. Those skilled in the art will recognize that too large of a spring constant will cause the package's hold on the product to be too rigid, thus potentially damaging the product. Conversely, a spring constant which is too low may allow the product to displace the fingers sufficiently that (under certain conditions) the product may impact the top or bottom wall of the box, thereby potentially damaging it. Thus, the spring constant is preferably optimized for the weight or range of weights of the products to be shipped in the package.

As will be apparent to those skilled in the art, the particular dimensions of the box 10 will depend largely upon the size and weight of the product to be contained. For example, one embodiment of a container for packaging delicate semiconductor equipment may comprise a height of about 1.5" to about 3", a width (front-to-back) of about 6" to about 8", a length (out of the page in FIG. 1) of about 26" to about 31". In such a container, the mounting strips 54 of the sheets 50 are between about 25" and 28" in length 56. One particular embodiment of a container as described herein has a height of about 1.8", an internal width of about 6", and an internal length of about 28".

As mentioned above, the materials from which the container and flexible fingers are made are preferably substantially cleanroom compatible. Cleanroom standards for loose particulate are well known to those skilled in the art, and vary according to the class of cleanroom in question. In general, however, the container described herein is preferably made of materials which are substantially free from loose particles. Many suitable materials known to those skilled in the art meet the various requirements for cleanroom compatibility. Additionally, the container is preferably made from a sufficiently durable material that it may be cleaned if necessary, and re-used. Of course a packaging system as described herein may also be made of substantially non-cleanroom compatible materials if so desired.

Thus a container as described herein is cleanroom compatible, capable of containing a wide variety of products safely and of protecting delicate products from damage. A container as described herein may also be cleaned and reused.

Although certain preferred embodiments and examples have been described herein, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A packaging apparatus comprising:

a top portion having a top wall, a front wall a rear wall, and a plurality of sides;

a bottom portion having a bottom wall, a front wall, a rear wall, and a plurality of sides;

a first sheet of flexible fingers mounted to the front wall of said top portion;

a second sheet of flexible fingers mounted to the rear wall of said top portion;

a third sheet of flexible fingers mounted to the front wall of said bottom portion; and a fourth sheet of flexible fingers mounted to the rear wall of said bottom portion;

wherein the fingers of the first sheet interlace the fingers of the second sheet; and wherein the fingers of the third sheet interlace the fingers of the fourth sheet.

2. The apparatus of claim 1, wherein the fingers of at least one of the first sheet, the second sheet, the third sheet, and the fourth sheet are substantially convex relative to a product to be placed between the top fingers and the bottom fingers.

3. The apparatus of claim 1, wherein the fingers are of equal width.

4. The apparatus of claim 1, wherein at least one of the first sheet, the second sheet, the third sheet, and the fourth sheet has one edge mounted to the box.

5. The apparatus of claim 4, wherein at least one of the first sheet, the second sheet, the third sheet, and the fourth sheet has two edges mounted to the box.

6. The apparatus of claim 1, wherein the flexible fingers of the first, second, third and fourth sheets are adapted to support a product placed directly thereon.

* * * * *